US009122297B2

(12) United States Patent
Kameda et al.

(10) Patent No.: US 9,122,297 B2
(45) Date of Patent: Sep. 1, 2015

(54) MASTER CONTROLLER

(75) Inventors: Takashi Kameda, Chiyoda-ku (JP); Ichirou Okui, Tanba (JP); Masao Okai, Tanba (JP)

(73) Assignee: MITSUBISHI ELECTRIC CORPORATION, Chiyoda-Ku, Tokyo (JP)

( * ) Notice: Subject to any disclaimer, the term of this patent is extended or adjusted under 35 U.S.C. 154(b) by 0 days.

(21) Appl. No.: 14/348,126

(22) PCT Filed: Sep. 28, 2011

(86) PCT No.: PCT/JP2011/072245

§ 371 (c)(1),
(2), (4) Date: Mar. 28, 2014

(87) PCT Pub. No.: WO2013/046372

PCT Pub. Date: Apr. 4, 2013

(65) Prior Publication Data

US 2015/0040714 A1 Feb. 12, 2015

(51) Int. Cl.

| | |
|---|---|
| ***G05G 1/00*** | (2008.04) |
| ***G05G 11/00*** | (2006.01) |
| ***G05G 13/00*** | (2006.01) |
| ***G05G 5/00*** | (2006.01) |

(Continued)

(52) U.S. Cl.

CPC ..... *G05G 5/005* (2013.01); *G05G 1/04* (2013.01); *G05G 5/08* (2013.01)

(58) Field of Classification Search

CPC ..... G05G 1/04; G05G 5/08; G05G 5/005; G05G 5/28

See application file for complete search history.

(56) References Cited

U.S. PATENT DOCUMENTS 4,183,257 A * 1/1980 Lovenduski ..... 74/473.21
5,062,316 A * 11/1991 Lykken et al. ..... 74/529

(Continued)

FOREIGN PATENT DOCUMENTS

JP 56-7405 U 1/1981
JP 57-19917 A 2/1982

(Continued)

OTHER PUBLICATIONS

International Search Report (PCT/ISA/210) mailed on Dec. 13, 2011, by the Japanese Patent Office as the International Searching Authority for International Application No. PCT/JP2011/072245.

(Continued)

*Primary Examiner* — David M Fenstermacher
*Assistant Examiner* — Jake Cook
(74) *Attorney, Agent, or Firm* — Buchanan Ingersoll & Rooney PC

(57) ABSTRACT

The master controller includes a main handle, a handle drum, a reverse handle, a lock collar, a first lock cam having an outer peripheral surface that locks the reverse handle at a neutral position when an operation key is at a locked position, a second lock cam that rotates integrally with the reverse handle, and has an outer peripheral surface that locks the reverse handle and the main handle at a neutral position when the operation key is at a locked position, and that locks the reverse handle at a forward position or a reverse position and unlocks the main handle when the reverse handle is operated to the forward position or the reverse position, and a rod holding unit that holds a rod movably between the lock collar and the second lock cam.

8 Claims, 3 Drawing Sheets

(51) Int. Cl.
*G05G 5/08* (2006.01)
*G05G 1/04* (2006.01)

(56) References Cited

U.S. PATENT DOCUMENTS

| | | | | |
|---|---|---|---|---|
| 6,176,809 | B1 * | 1/2001 | Visser et al. | 477/99 |
| 6,338,288 | B1 * | 1/2002 | Spadaccini et al. | 74/529 |
| 6,568,228 | B2 * | 5/2003 | Hasegawa | 70/247 |

FOREIGN PATENT DOCUMENTS

| | | | |
|---|---|---|---|
| JP | 58-72903 | U | 5/1983 |
| JP | 58-97906 | U | 7/1983 |
| JP | 60-93404 | U | 6/1985 |
| JP | 3-21903 | U | 3/1991 |
| JP | 5-244707 | A | 9/1993 |
| JP | 6-72319 | A | 3/1994 |
| JP | 11-55811 | A | 2/1999 |
| JP | 2011-97726 | A | 5/2011 |

OTHER PUBLICATIONS

Written Opinion (PCT/ISA/237) mailed on Dec. 13, 2011, by the Japanese Patent Office as the International Searching Authority for International Application No. PCT/JP2011/072245.

* cited by examiner

MASTER CONTROLLER

FIELD

The present invention relates to a master controller for a railway vehicle.

BACKGROUND

A master controller that performs power running (a forward or reverse movement) of a railway vehicle and issues an operation control command for a braking operation or the like is installed in a cockpit of the railway vehicle. The master controller is provided with a main handle operated by a driver, and a reverse handle for selecting a traveling direction (a forward or reverse movement) of the railway vehicle. Furthermore, the master controller is provided with a mechanism that mechanically interlocks the main handle and the reverse handle (prevents mutual interference). The interlock mechanism is configured such that the main handle cannot be rotated, for example, when the reverse handle is at a neutral position, and the reverse handle can not be rotated except for a case where the main handle is at a neutral position (a position where both power running and deceleration are not controlled).

For example, in a conventional technique disclosed in Patent Literature 1, when a driving key is inserted and a key cam is rotated together with a key shaft, the lock between a reverse cam interlocked with a reverse handle and the key cam is released to enable a rotating operation of the reverse handle. When the reverse handle is at a neutral position, a lock lever is engaged with a concave portion of a lock collar interlocked with the main handle. Therefore, the rotating operation of the main handle is interrupted. However, when the rotating operation of the reverse handle is performed, the lock lever turns due to an energizing force of a spring. Accordingly, the lock between the lock collar and the lock lever is released to enable the rotating operation of the main handle.

CITATION LIST

Patent Literature

Patent Literature 1: Japanese Utility Model Laid-open Publication No. S58-97906 (for example, FIG. 1).

SUMMARY

Technical Problem

However, because a spring is used in the interlock mechanism in the conventional technique described above, the spring needs to be replaced regularly, and if the spring is broken, the lock cannot be released, or the lock can be released unintentionally. Furthermore, the interlock mechanism in the conventional technique described above has a complicated structure because of using the spring, and thus it is difficult to meet needs for reduction of machining manhours at the time of manufacture or needs for improving reliability by simplifying the mechanism.

The present invention has been achieved to solve the above problems, and an object of the present invention is to acquire a master controller capable of improving reliability.

Solution to Problem

The present invention is directed to a master controller that achieves the object. The master controller includes a main handle that performs a speed-control operation of a railway vehicle; a handle drum that is turned in a direction in which the main handle is operated; a reverse handle that is provided turnably on an axial line orthogonal to a spindle of the handle drum and reverses a traveling direction of the railway vehicle; a lock collar that is formed in a disk shape having a smaller diameter than that of the handle drum and is attached to an end face of the handle drum about the spindle of the handle drum to lock an operation of the main handle when the reverse handle is at a neutral position; a first lock cam that is formed in a plate-like shape, rotates integrally with an operation key that is turned about an axial line orthogonal to the spindle of the handle drum, and has an outer peripheral surface that locks the reverse handle at a neutral position when the operation key is at a locked position; a second lock cam that rotates integrally with the reverse handle, and has an outer peripheral surface that locks the reverse handle and the main handle at a neutral position when the operation key is at a locked position, and that locks the reverse handle at a forward position or a reverse position and unlocks the main handle when the reverse handle is operated to the forward position or the reverse position; and a rod holding unit that holds a rod movably between the lock collar and the second lock cam, the rod being extended parallel to the spindle of the handle drum from an end face of the lock collar toward the outer peripheral surface of the second lock cam.

Advantageous Effects of Invention

According to the present invention, because the mechanism of mechanically interlocking the main handle and the reverse handle without using a spring is provided, the reliability can be improved.

DESCRIPTION OF EMBODIMENTS

Exemplary embodiments of a master controller according to the present invention will be explained below in detail with reference to the accompanying drawings. The present invention is not limited to the embodiments.

Embodiment

Figure 1:
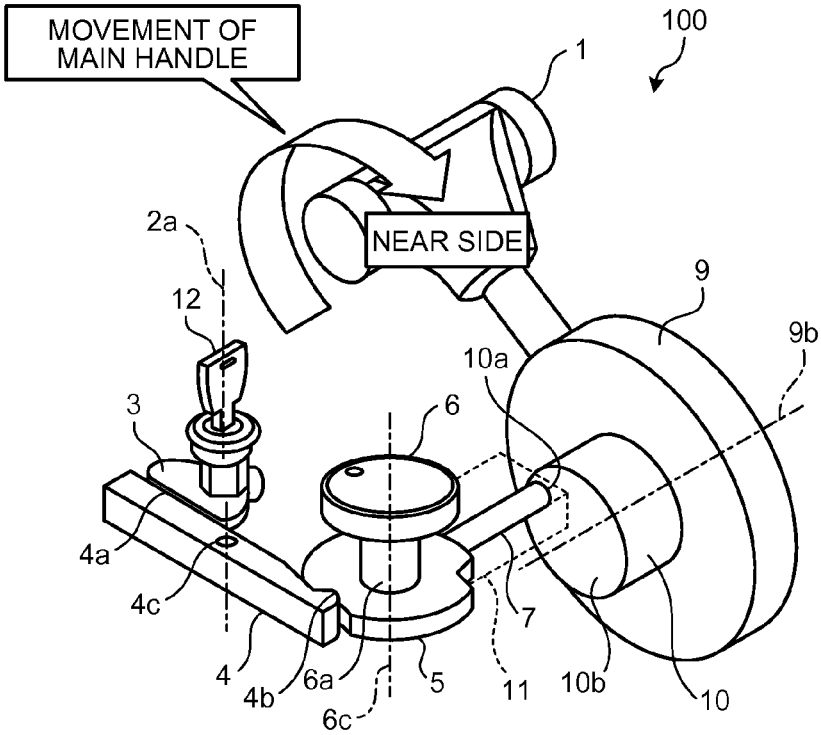
FIG. 1 is a configuration diagram of a master controller according to an embodiment of the present invention.
Figure 2:
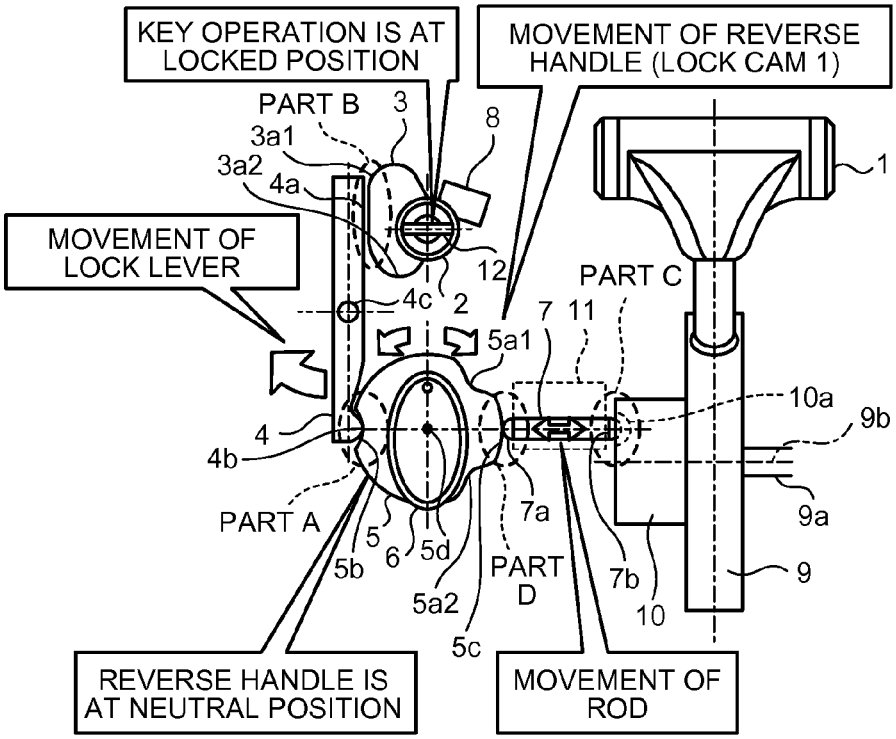
FIG. 2 is an explanatory diagram of an operation when an operation key is in an OFF state.
Figure 3:
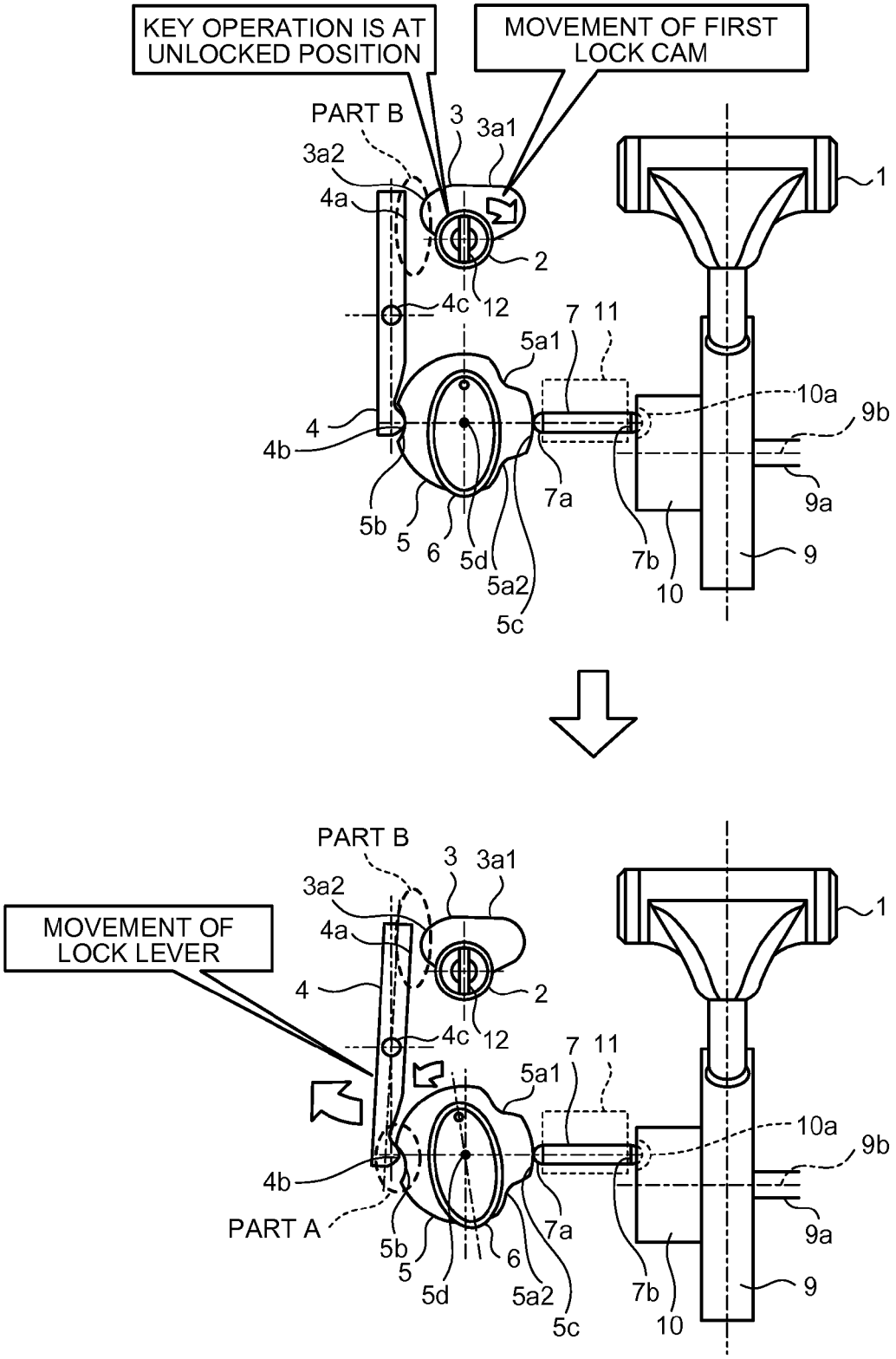
FIG. 3 is an explanatory diagram of a first operation when the operation key is changed from an OFF state to an ON state.
Figure 4:
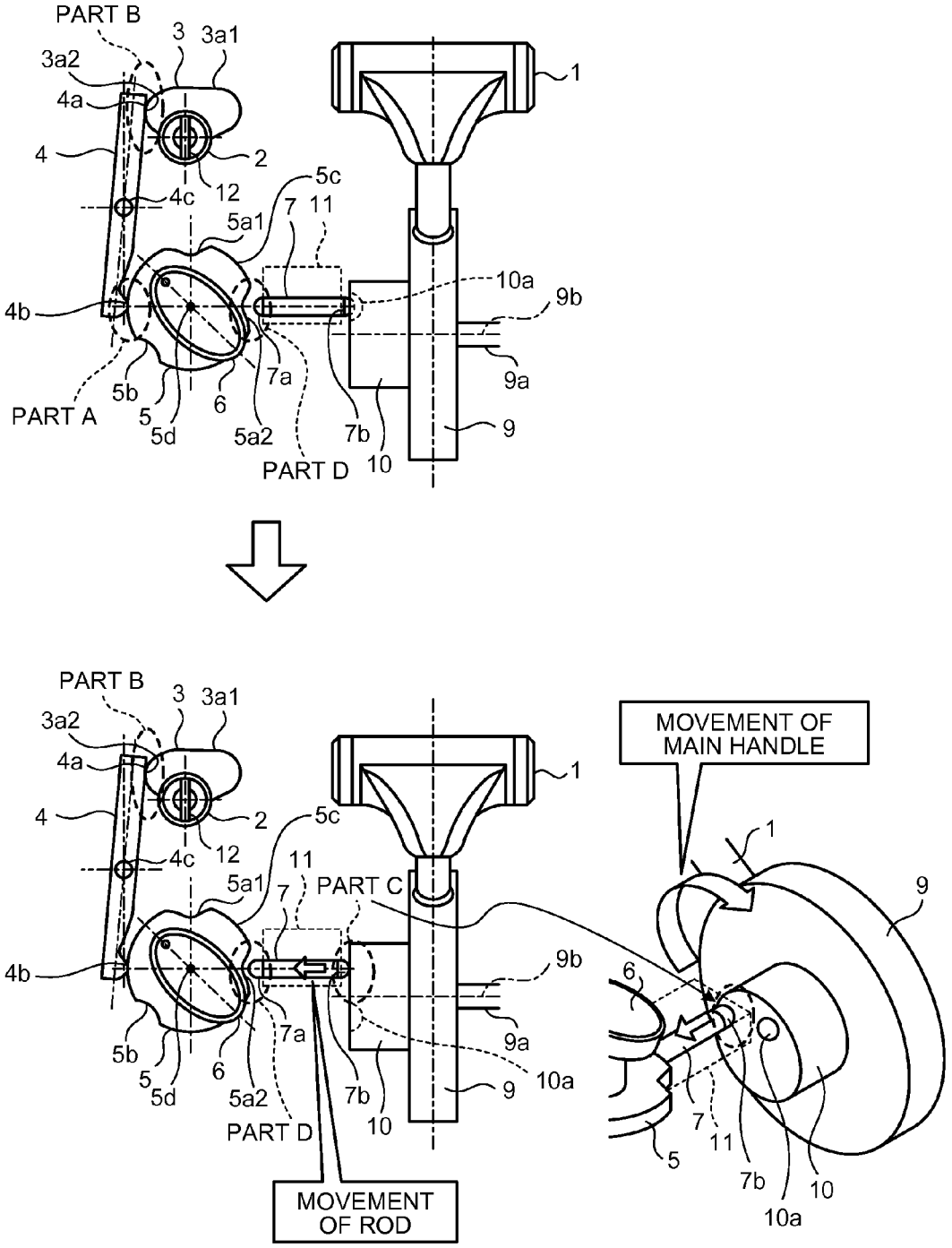
FIG. 4 is an explanatory diagram of a second operation when the operation key is changed from an OFF state to an ON state.

FIG. 1 is a configuration diagram of a master controller 100 according to an embodiment of the present invention. FIG. 2 is an explanatory diagram of an operation when an operation key is in an OFF state. FIG. 3 is an explanatory diagram of a first operation when the operation key is changed from an OFF state to an ON state. FIG. 4 is an explanatory diagram of a second operation when the operation key is changed from an OFF state to an ON state.

In FIG. 1, the master controller 100 includes a main handle 1, a handle drum 9 that turns integrally with the main handle 1, a key guide 2, a first lock cam 3 being a cam-like plate provided integrally with the key guide 2, a reverse handle (a forward/reverse handle) 6, a second lock cam 5 being a cam-like plate provided integrally with the reverse handle 6, a lock lever 4, a rod holding unit 11, and a rod 7 fitted to the rod holding unit 11, as main constituent elements.

The key guide 2 is formed so that an operation key 12 can be inserted therein. For example, when the operation key 12 is inserted, as shown in FIG. 2, the key guide 2 is at a locked position. When the key guide 2 is rotated after the operation key 12 is inserted therein, the key guide 2 is at a released position as shown in FIG. 3. At this time, a key-operation interlock switch 8 for transmitting various electric signals to respective units of the railway vehicle operates.

The plate-like first lock cam 3 that turns in the same direction as a turning direction of the key guide 2 about a key axial line 2*a* is provided integrally with the key guide 2. A first cam surface 3*a*1 facing one end 4*a* of the lock lever 4 when the operation key 12 is at a locked position, and a second cam surface 3*a*2 facing the one end 4*a* of the lock lever 4 when the operation key 12 is at a released position are formed on an outer peripheral surface of the first lock cam 3. A radius of curvature of the first lock cam 3 from a point of intersection between the axial line 2*a* of the operation key 12 and the first lock cam 3 is formed to be small from the first cam surface 3*a*1 toward the second cam surface 3*a*2. By having such cam surfaces, the first lock cam 3 locks or unlocks a rotating operation of the reverse handle 6.

The lock lever 4 has a columnar shape extended in a direction orthogonal to a lock lever spindle 4*c* provided in parallel with the key axial line 2*a* and a reverse-handle axial line 6*c*, and is formed to turn about the lock lever spindle 4*c*.

The one end 4*a* on a side surface of the lock lever 4 is arranged at a position facing the outer peripheral surface of the first lock cam 3, and the other end 4*b* on the same surface as the side surface of the lock lever 4 is arranged at a position facing the outer peripheral surface of the second lock cam 5. That is, in the lock lever 4, one side surface of the lock lever 4 is provided to face the outer peripheral surface of the first lock cam 3 and the outer peripheral surface of the second lock cam 5. The one end 4*a* of the lock lever 4 comes in contact with the first cam surface 3*a*1 or the second cam surface 3*a*2 formed on the first lock cam 3 with turning of the first lock cam 3. The other end 4*b* of the lock lever 4 has a curved convex shape toward the second lock cam 5, and comes in contact with the outer peripheral surface of the second lock cam 5.

The reverse handle 6 is attached to one end of a reverse handle spindle 6*a* provided in parallel with the key axial line 2*a*. The reverse handle 6 is a manual handle capable of selecting three positions of a forward movement, a reverse movement, and neutral. For example, when the reverse handle 6 is rotated clockwise from the neutral position shown in FIG. 2, the railway vehicle becomes a condition capable of moving forward, and when the reverse handle 6 is operated counterclockwise from the neutral position shown in FIG. 2, the railway vehicle becomes a condition capable of reversing.

The second lock cam 5 having a short columnar shape and turning in the same direction as the turning direction of the reverse handle 6 about the reverse-handle axial line 6*c* is provided at the other end of the reverse handle spindle 6*a*. A first engagement portion 5*a*1 that engages with one end 7*a* of the rod 7 when the railway vehicle is moved forward, a second engagement portion 5*a*2 that engages with the one end 7*a* of the rod 7 when the railway vehicle is reversed, and a third engagement portion 5*b* that engages with the other end 4*b* of the lock lever 4 when turning of the reverse handle 6 is locked are formed on the outer peripheral surface of the second lock cam 5. In the explanation below, the outer peripheral surface of the second lock cam 5 except for the first engagement portion 5*a*1, the second engagement portion 5*a*2, and the third engagement portion 5*b* is referred to as "crest portion 5*c*".

The first engagement portion 5*a*1 is formed in a curved concave shape so that the one end 7*a* of the rod 7 can be pushed out when the reverse handle 6 is rotated counterclockwise while engaging with the one end 7*a* of the rod 7. Similarly, the second engagement portion 5*a*2 is formed in a curved concave shape so that the one end 7*a* of the rod 7 can be pushed out when the reverse handle 6 is rotated clockwise while engaging with the one end 7*a* of the rod 7. Furthermore, the third engagement portion 5*b* is formed in a curved concave shape so that the other end 4*b* of the lock lever 4 can be pushed out when the reverse handle 6 is rotated clockwise or counterclockwise while engaging with the other end 4*b* of the lock lever 4. The master controller 100 according to the present embodiment can lock or unlock the rotating operation of the reverse handle 6 and the main handle 1 by forming such cam surfaces on the second lock cam 5.

The main handle 1 is a T-shaped handle movable in a front-back direction to execute drive control of the railway vehicle. When a driver operates the main handle 1 from a neutral position to a position other than the neutral position, the railway vehicle accelerates or decelerates. The neutral position is, for example, a position when the other end 7*b* of the rod 7 is engaging with an engagement portion 10*a* formed in a lock collar 10, as shown in FIGS. 1 and 2, and the position other than the neutral position is, for example, a position when the main handle 1 is operated to a near side or a far side than the neutral position.

The main handle 1 is provided on an outer periphery of the handle drum 9. The handle drum 9 has a disk-like shape, and turns in a direction in which the main handle 1 is operated about a handle drum spindle 9*a* provided in a direction orthogonal to the reverse-handle axial line 6*c*.

The lock collar 10 having the engagement portion 10*a* for locking turning of the handle 1 is provided on an end face of the handle drum 9 (a face on the side of the reverse handle 6). The lock collar 10 has a disk-like shape having a smaller diameter than an outer diameter of the handle drum 9, and is fitted to the handle drum spindle 9*a*.

The engagement portion 10*a* engages with the other end 7*b* of the rod 7 pushed out toward the handle drum 9 by turning of the reverse handle 6, when the reverse handle 6 is rotated to the neutral position. Because the other end 7*b* of the rod 7 goes into the engagement portion 10*a*, the rotating operation of the main handle 1 provided integrally with the lock collar 10 is locked. The engagement portion 10*a* is formed in a curved concave shape so as to be able to push out the other end 7*b* of the rod 7 when the main handle 1 is rotated while engaging with the other end 7*b* of the rod 7. The engagement portion 10*a* is provided at a position offset from a handle-drum axial line 9*b* toward the outer periphery of the lock collar 10.

The rod holding unit 11 into which the rod 7 is fitted is provided between the lock collar 10 and the second lock cam 5. The rod 7 has a rod-like shape extending parallel to the handle drum spindle 9*a* from the end face 10*b* of the lock collar 10 toward the outer peripheral surface of the second lock cam 5. The rod 7 is arranged movably between the lock collar 10 and the second lock cam 5.

The one end 7*a* of the rod 7 is arranged at a position opposite to the outer peripheral surface of the second lock cam 5, and is formed, for example, in a curved convex shape so as to be able to engage with the first engagement portion

5*a*1 or the second engagement portion 5*a*2. Furthermore, the other end 7*b* of the rod 7 is arranged at a position opposite to the end face 10*b* of the lock collar 10, and is formed, for example, in a curved convex shape so as to be able to engage with the engagement portion 10*a*. When the one end 7*a* of the rod 7 is engaging with the first engagement portion 5*a*1 or the second engagement portion 5*a*, the rotating operation of the reverse handle 6 is prevented. When the other end 7*b* of the rod 7 is engaging with the engagement portion 10*a*, the rotating operation of the main handle 1 is prevented.

Operations of the present embodiment are explained below. An operation when the operation key 12 is locked is explained first.

In a part B shown in FIG. 2, when the operation key is at a locked position, the one end 4*a* of the lock lever 4 interferes with the first cam surface 3*a*1, or a slight gap is formed between the one end 4*a* of the lock lever 4 and the first cam surface 3*a*1. At this time, in a part A shown in FIG. 2, the other end 4*b* of the lock lever 4 goes into the third engagement portion 5*b* of the second lock cam 5. When the reverse handle 6 is rotated clockwise or counterclockwise in this way, in a state where the other end 4*b* of the lock lever 4 thus goes into the third engagement portion 5*b*, the other end 4*b* of the lock lever 4 is caught on the second lock cam 5.

When the reverse handle 6 is operated more strongly, a force attempting to push out the lock lever 4 acts on the other end 4*b* of the lock lever 4 due to the curved shape of the third engagement portion 5*b*. At this time, the lock lever 4 attempts to rotate clockwise about the lock lever spindle 4*c*. However, because the rotation of the lock lever 4 is interrupted by the first cam surface 3*a*1, the state where the other end 4*b* of the lock lever 4 is caught on the third engagement portion 5*b* is not released, and the rotating operation of the reverse handle 6 is interrupted.

On the other hand, when the other end 4*b* of the lock lever 4 goes into the third engagement portion 5*b*, the one end 7*a* of the rod 7 faces the crest portion 5*c* as shown in a part D in FIG. 2, and the other end 7*b* of the rod 7 goes into the engagement portion 10*a* of the lock collar 10, as shown in a part C in FIG. 2. In this way, when the main handle 1 is operated to the near side in a state where the other end 7*b* of the rod 7 goes into the engagement portion 10*a*, the other end 7*b* of the rod 7 is caught on the engagement portion 10*a*.

When the main handle 1 is operated more strongly, a force attempting to push out the rod 7 acts on the other end 7*b* of the rod 7 due to the curved shape of the engagement portion 10*a*. At this time, the rod 7 attempts to move toward the second lock cam 5. However, because the movement of the rod 7 is interrupted by the crest portion 5*c*, the state where the other end 7*b* of the rod 7 is caught on the engagement portion 10*a* is not released, and the rotating operation of the main handle 1 is interrupted.

An operation when the operation key 12 is unlocked is explained next.

In FIG. 3, when the operation key 12 is at an unlocked position, a gap is formed as shown in the part B between the one end 4*a* of the lock lever 4 and the outer peripheral surface of the first lock cam 3 (the second cam surface 3*a*2). When the reverse handle 6 is rotated counterclockwise in a state where the gap is thus formed between the one end 4*a* of the lock lever 4 and the outer peripheral surface of the first lock cam 3, the force attempting to push out the lock lever 4 acts on the other end 4*b* of the lock lever 4 due to the curved shape of the third engagement portion 5*b*. Accordingly, the other end 4*b* of the lock lever 4 is pushed out from the third engagement portion 5*b* as shown in the part A, and as a result, the rotating operation of the reverse handle 6 becomes possible.

In FIG. 4, when the reverse handle 6 is operated further, the other end 4*b* of the lock lever 4 comes in a state of running on the outer peripheral surface of the second lock cam 5, as shown in the part A. At this time, a gap is formed as shown in the part D between the second engagement portion 5*a*2 of the second lock cam 5 and the one end 7*a* of the rod 7.

When the main handle 1 is operated to the near side in a state where the gap is thus formed between the second engagement portion 5*a*2 of the second lock cam 5 and the one end 7*a* of the rod 7, the rod 7 is pushed out due to the curved shape of the engagement portion 10*a*. Therefore, the rod 7 moves toward the second lock cam 5 (leftward in FIG. 4), and the one end 7*a* of the rod 7 goes into the second engagement portion 5*a*2. The other end 7*b* of the rod 7 comes in a state of running on the end face 10*b* of the lock collar 10, as shown in the part C. Therefore, the rotating operation of the main handle 1 becomes possible.

When the operation of the main handle 1 is possible, there is no space between the rod 7 and the lock collar 10 for the rod 7 to move toward the side of the lock collar 10 (rightward in FIG. 4). Therefore, when the reverse handle 6 is rotated clockwise or counterclockwise from the position shown in FIG. 4, a force attempting to push out the rod 7 acts on the one end 7*a* of the rod 7 due to the curved shape of the second engagement portion 5*a*2. At this time, the rod 7 attempts to move toward the side of the lock collar 10. However, because the movement of the rod 7 is interrupted by the end face 10*b* of the lock collar 10 (that is, a portion other than the portion where the engagement portion 10*a* is formed), the state where the one end 7*a* of the rod 7 is caught on the second engagement portion 5*a*2 is not released, and the rotating operation of the reverse handle 6 is interrupted.

When the operation of the main handle 1 is possible as shown in FIG. 4, when the operation key 12 is operated counterclockwise (that is, when the operation key 12 is rotated from an unlocked position to a locked position), the outer peripheral surface of the first lock cam 3 interferes with the one end 4*a* of the lock lever 4, to interrupt the operation. These operations are specifically explained below. Because a distance from the point of intersection between the key axial line 2*a* and the first lock cam 3 to the first cam surface 3*a*1 is longer than a distance from the point of intersection to the second cam surface 3*a*2, when the operation key 12 is rotated from an unlocked position to a locked position, an energizing force from the first lock cam 3 acts on the lock lever 4. However, in a state where the operation of the main handle 1 is possible, the other end 4*b* of the lock lever 4 runs on the crest portion 5*c* of the second lock cam 5. Therefore, turning of the lock lever 4 is restricted, and the rotating operation of the operation key 12 is also interrupted.

When the reverse handle 6 is at a neutral position in this way, the one end 7*a* of the rod 7 faces the crest portion 5*c* of the second lock cam 5, and the other end 7*b* of the rod 7 engages with the engagement portion 10*a* of the lock collar 10. Therefore, when the operation key 12 is at an unlocked position, the reverse handle 6 is occasionally rotated from the neutral position to a reverse position (or a forward position). However, the main handle 1 is not rotated to a position other than the neutral position, until the reverse handle 6 is set to the reverse position (or the forward position).

Furthermore, when the reverse handle 6 is at a reverse position (or a forward position), the one end 7*a* of the rod 7 engages with the second engagement portion 5*a*2 (or the first engagement portion 5*a*1), and the other end 7*b* of the rod 7 comes in contact with a portion other than the engagement portion 10*a* of the lock collar 10. Therefore, the main handle 1 is occasionally rotated from a position other than the neutral position to the neutral position. However, the reverse handle 6 is not rotated to a position other than the reverse position (or the forward position), until the main handle 1 is set to the neutral position.

That is, the master controller 100 according to the present embodiment has a mechanism that mechanically interlocks the main handle 1 and the reverse handle 6 (prevents mutual interference), so that the rotating operation of the main handle 1 is prevented when the reverse handle 6 is at a neutral position, and the rotating operation of the reverse handle 6 is prevented when the main handle 1 is at a position other than the neutral position.

In the present embodiment, a configuration example in which the first lock cam 3 is provided on the side of the first engagement portion 5*a*1 (for example, the upper side in FIG. 2) than an extension line connecting the third engagement portion 5*b* and the rod 7 has been explained as an example. However, the present invention is not limited thereto. That is, the master controller 100 according to the present embodiment can be configured such that the first lock cam 3 is provided on the side of the second engagement portion 5*a*2 (for example, the lower side in FIG. 2) than the extension line connecting the third engagement portion 5*b* and the rod 7, and one side surface of the lock lever 4 is installed to face the outer peripheral surface of the first lock cam 3 and the outer peripheral surface of the second lock cam 5.

In the present embodiment, a configuration example in which the rotating operation of the reverse handle 6 is locked by using the lock lever 4 has been explained. However, the present invention is not limited thereto, and a mechanism that engages or disengages with the third engagement portion 5*b* corresponding to turning of the operation key 12 can be provided instead of the lock lever 4.

As explained above, the master controller 100 according to the embodiment of the present invention includes the main handle 1 that performs a speed-control operation of the railway vehicle, the handle drum 9 that is turned in the direction in which the main handle 1 is operated, the reverse handle 6 provided turnably on the axial line 6*c* orthogonal to the spindle 9*a* of the handle drum 9 to reverse the traveling direction of the railway vehicle, and the lock collar 10 formed in a disk shape having a smaller diameter than that of the handle drum 9 and attached to the end face of the handle drum 9 about the spindle 9*a* of the handle drum 9 to lock the operation of the main handle 1 when the reverse handle 6 is at a neutral position. The master controller 100 further includes the first lock cam 3 that is formed in a plate-like shape, rotates integrally with the operation key 12 that is turned about the axial line 2*a* orthogonal to the spindle 9*a* of the handle drum 9, and has the outer peripheral surfaces (3*a*1, 3*a*2) that lock the reverse handle 6 at a neutral position when the operation key 12 is at a locked position, and the second lock cam 5 that rotates integrally with the reverse handle 6, and has the outer peripheral surface that locks the reverse handle 6 and the main handle 1 at a neutral position when the operation key 12 is at a locked position, and that locks the reverse handle 6 at a forward position or a reverse position and unlocks the main handle 1 when the reverse handle 6 is operated to the forward position or the reverse position. The master controller 100 further includes the rod holding unit 11 that holds the rod 7 movably between the lock collar 10 and the second lock cam 5, wherein the rod is extended parallel to the spindle 9*a* of the handle drum 9 from the end face 10*b* of the lock collar 10 toward the outer peripheral surface of the second lock cam 5. Therefore, the reverse handle 6, the rod 7, and the lock collar 10 function as the interlock mechanism. In the conventional techniques, because a spring has been used for the interlock mechanism, the spring needs to be replaced regularly, and there is a problem that when the spring is broken, the lock cannot be released, or the lock may be released unintentionally. On the other hand, the master controller 100 according to the embodiment of the present invention can mechanically interlock the main handle 1 and the reverse handle 6 without using a spring. Therefore, replacement of the spring is unnecessary, and a lock failure does not occur. Furthermore, according to the master controller 100 according to the embodiment of the present invention, because the engagement structure of the reverse handle 6, the rod 7, and the lock collar 10 is simplified, machining man-hours at the time of manufacture can be reduced and the reliability can be improved, as compared to the conventional techniques.

The first engagement portion 5*a*1 that engages with the one end 7*a* of the rod 7 when the reverse handle 6 is at a forward position and the second engagement portion 5*a*2 that engages with the one end 7*a* of the rod 7 when the reverse handle 6 is at a reverse position are formed in the second lock cam 5 according to the embodiment of the present invention. Therefore, the interlock mechanism can be realized by only one second lock cam 5 without using a plurality of mechanisms that engage with the rod 7. As a result, the reliability of the master controller 100 can be improved, and the manufacturing cost of the second lock cam 5 and the maintenance cost can be reduced.

The master controller 100 according to the embodiment of the present invention includes the lock lever 4 formed in a columnar shape extending in the direction orthogonal to the axial line 2*a* of the operation key 12 and turnably provided on the lock lever spindle 4*c*, which is parallel to the axial line 2*a* of the operation key 12, to lock turning of the reverse handle 6 when the operation key 12 is at a locked position. The one end 4*a* of the side surface of the lock lever 4 is arranged at the position facing the outer peripheral surface of the first lock cam 3, and the other end 4*b* of the same surface as the side surface of the lock lever 4 is arranged at the position facing the outer peripheral surface of the second lock cam 5, has the curved convex shape toward the second lock cam 5, and comes in contact with the outer peripheral surface of the second lock cam 5. The second lock cam 5 is provided with the third engagement portion 5*b* that engages with the other end 4*b* of the lock lever 4 when the main handle 1 and the reverse handle 6 are at a neutral position. Accordingly, the reverse handle 6 can be locked or unlocked by slight turning of the lock lever 4 about the lock lever spindle 4*c*. In the conventional techniques, because a disk-like key cam that locks the reverse handle 6 is used, an installation area of the key cam increases, and thus the inner space of a cab is restricted. The lock lever 4 according to the embodiment of the present invention has a rod-like shape, and the turning width thereof is small. Accordingly, the inner space of the cab can be effectively used.

In the master controller 100 according to the embodiment of the present invention, the other end 4*b* of the lock lever 4 and the center 5*d* of the second lock cam 5 are provided on an extension line of the rod 7. Therefore, the interlock mechanism can be provided, for example, in a direction of the end face (the side surface on the side of reverse handle 6) of the handle drum 9. Because the main handle 1 and the reverse handle 6 are a man-machine interface, the installation positions thereof are determined by necessity, taking the operability of the driver into consideration. Therefore, if the interlock mechanism can be installed in the space between the main handle 1 and the reverse handle 6, the inner space of the cab is not restricted. In the conventional techniques, the interlock mechanism (for example, a lock lever that locks the main handle 1) is required not only in the direction of the end face of the handle drum 9 but also in the outer peripheral surface direction of the handle drum 9. Therefore, there is a problem that the inner space of the cab is restricted. However, according to the master controller 100 according to the embodiment of the present invention, the interlock can be provided on the end face of the handle drum 9. Accordingly, the inner space of the cab can be effectively used.

In the master controller 100 according to the embodiment of the present invention, the other end 4*b* of the lock lever 4, the one end 7*a* of the rod 7, and the other end 7*b* of the rod 7 are formed in a curved convex shape. Therefore, the rotating operation of the reverse handle 6 and the main handle 1 can be reliably locked. Further, the rotating operation of the reverse handle 6 and the main handle 1 can be performed without damaging the first engagement portion 5*a*1, the second engagement portion 5*a*2, the third engagement portion 5*b*, and the engagement portion 10*a*, as compared to a case where these ends are formed in a simple convex shape.

The first cam surface 3*a*1 that faces the one end 4*a* of the lock lever 4 when the operation key 12 is at a locked position, and the second cam surface 3*a*2 that faces the one end 4*a* of the lock lever 4 when the operation key 12 is at a released position are formed on the outer peripheral surface of the first lock cam 3 according to the embodiment of the present invention. The radius of curvature of the first lock cam 3 from the point of intersection between the axial line 2*a* of the operation key 12 and the first lock cam 3 is formed to be small from the first cam surface 3*a*1 toward the second cam surface 3*a*2. Accordingly, the operation key 12 and the reverse handle 6 can be mechanically interlocked without using a spring. That is, even if the key guide 2 is erroneously operated from an unlocked position to a locked position when the reverse handle 6 is set to a forward position or a reverse position, the first lock cam 3 comes in contact with the lock lever 4. Therefore, the operation of the key guide 2 can be prevented without using a mechanism having a complicated shape. As a result, the manufacturing cost can be reduced, durability is improved, and the reliability can be also improved, as compared to the conventional techniques.

The engagement portion 10*a* with which the other end 7*b* of the rod 7 engages when the main handle 1 is at a neutral position is formed on the lock collar 10 according to the embodiment of the present invention. Accordingly, the mechanism for locking the rotating operation of the main handle 1 is simplified, and the reliability of the master controller 100 can be improved.

In the master controller 100 according to the embodiment of the present invention, the first engagement portion 5*a*1, the second engagement portion 5*a*2, the third engagement portion 5*b*, and the engagement portion 10*a* are formed in a curved concave shape. Therefore, the rotating operation of the reverse handle 6 and the main handle 1 can be reliably locked, and the rotating operation of the reverse handle 6 and the main handle 1 can be performed without damaging the other end 4*b* of the lock lever 4 and the opposite ends of the rod 7, as compared to a case where these portions are formed in a simple concave shape.

The master controller 100 according to the embodiment of the present invention is only an example of the contents of the present invention. The configuration thereof can be combined with other well-known techniques, and it is needless to mention that the present invention can be configured while modifying it without departing from the scope of the invention, such as omitting a part of the configuration.

INDUSTRIAL APPLICABILITY

As described above, the present invention is applicable to a master controller and is particularly useful as an invention capable of enhancing reliability.

REFERENCE SIGNS LIST

1 main handle
2 key guide
2*a* key axial line
3 first lock cam
3*a*1 first cam surface
3*a*2 second cam surface
4 lock lever
4*a*, 7*a* one end
4*b*, 7*b* other end
4*c* lock lever spindle
5 second lock cam
5*a*1 first engagement portion
5*a*2 second engagement portion
5*b* third engagement portion
5*c* crest portion
5*d* center
6 reverse handle
6*a* reverse handle spindle
6*c* reverse-handle axial line
7 rod
8 key-operation interlock switch
9 handle drum
9*a* handle drum spindle
9*b* handle-drum axial line
10 lock collar
10*a* engagement portion
10*b* end face
11 rod holding unit
12 operation key
100 master controller

The invention claimed is:

1. A master controller comprising:

a main handle that performs a speed-control operation of a railway vehicle;

a handle drum that is turned in a direction in which the main handle is operated;

a reverse handle that is provided turnably on an axial line orthogonal to a spindle of the handle drum and reverses a traveling direction of the railway vehicle;

a lock collar that is formed in a disk shape having a smaller diameter than that of the handle drum and is attached to an end face of the handle drum about the spindle of the handle drum to lock an operation of the main handle when the reverse handle is at a neutral position;

a first lock cam that is formed in a plate-like shape, rotates integrally with an operation key that is turned about an axial line orthogonal to the spindle of the handle drum, and has an outer peripheral surface that locks the reverse handle at a neutral position when the operation key is at a locked position;

a second lock cam that rotates integrally with the reverse handle, and has an outer peripheral surface that locks the reverse handle and the main handle at a neutral position when the operation key is at a locked position, and that locks the reverse handle at a forward position or a reverse position and unlocks the main handle when the reverse handle is operated to the forward position or the reverse position; and a rod holding unit that holds a rod movably between the lock collar and the second lock cam, the rod being extended parallel to the spindle of the handle drum from an end face of the lock collar toward the outer peripheral surface of the second lock cam.

2. The master controller according to claim 1, wherein the second lock cam includes a first engagement portion that engages with one end of the rod when the reverse handle is at a forward position, and a second engagement portion that engages with the one end of the rod when the reverse handle is at a reverse position.

3. The master controller according to claim 2, further comprising:

a lock lever formed in a columnar shape extending in a direction orthogonal to an axial line of the operation key and turnably provided on a spindle parallel to the axial line of the operation key to lock turning of the reverse handle when the operation key is at a locked position; and wherein one end of a side surface of the lock lever is arranged at a position facing the outer peripheral surface of the first lock cam;

wherein the other end of a same surface as the side surface of the lock lever is arranged at a position facing the outer peripheral surface of the second lock cam, has a protruding shape toward the second lock cam, and comes in contact with the outer peripheral surface of the second lock cam; and wherein the second lock cam includes a third engagement portion that engages with the other end of the lock lever when the main handle and the reverse handle are at a neutral position.

4. The master controller according to claim 3, wherein the other end of the lock lever and a center of the second lock cam are provided on an extension line of the rod.

5. The master controller according to claim 3, wherein the other end of the lock lever, the one end of the rod, and the other end of the rod are formed in a curved convex shape.

6. The master controller according to claim 3, wherein the outer peripheral surface of the first lock cam includes a first cam surface that faces the one end of the lock lever when the operation key is at a locked position, and a second cam surface that faces the one end of the lock lever when the operation key is at a released position; and wherein the first lock cam has a radius of curvature, from a point of intersection between the axial line of the operation key and the first lock cam, which is formed to be small from the first cam surface toward the second cam surface.

7. The master controller according to claim 1, wherein the lock collar includes an engagement portion with which the other end of the rod engages when the main handle is at a neutral position.

8. The master controller according to claim 7, wherein the first engagement portion, the second engagement portion, the third engagement portion, and the engagement portion are formed in a curved concave shape.

* * * * *